US007762651B2

(12) United States Patent
Stathem et al.

(10) Patent No.: US 7,762,651 B2
(45) Date of Patent: Jul. 27, 2010

(54) PRINTING DEVICE FLUID RESERVOIR

(75) Inventors: Ralph L. Stathem, Lebanon, OR (US); David N. Olsen, Corvallis, OR (US); Mark A. Smith, Corvallis, OR (US); Marjan S. Amesbury, Albany, OR (US); Greg K. Justice, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1104 days.

(21) Appl. No.: 11/173,779

(22) Filed: Jun. 30, 2005

(65) Prior Publication Data

US 2007/0013734 A1 Jan. 18, 2007

(51) Int. Cl.
*B41J 2/17* (2006.01)
*B41J 2/175* (2006.01)

(52) U.S. Cl. ..... 347/84; 347/86

(58) Field of Classification Search ..... 347/84–87
See application file for complete search history.

(56) References Cited

U.S. PATENT DOCUMENTS 5,325,119 A 6/1994 Fong
5,541,632 A 7/1996 Khodapanah
5,903,292 A 5/1999 Scheffelin
5,988,803 A 11/1999 Komplin
6,186,620 B1 * 2/2001 Hsieh et al. ..... 347/84
6,293,666 B1 9/2001 Mou
6,341,853 B1 1/2002 Scheffelin
6,494,568 B2 * 12/2002 Hou et al. ..... 347/86
6,505,924 B2 1/2003 Shimizu
6,513,919 B2 2/2003 Shyn
6,540,341 B2 * 4/2003 Hsieh et al. ..... 347/86
6,568,801 B2 5/2003 Shyn
6,736,497 B2 5/2004 Jung
6,739,710 B2 5/2004 Lin
6,758,548 B2 7/2004 Davis
2001/0038405 A1 * 11/2001 Ishizawa et al. ..... 347/86
2004/0075720 A1 4/2004 Hsu

FOREIGN PATENT DOCUMENTS

EP 1020293 B1 11/2004

OTHER PUBLICATIONS

English translation of First Office Action issued by State Intellectual Property Office of China on Jun. 12, 2009 for application No. 200680023779.2, application date Jun. 19, 2006.

* cited by examiner

*Primary Examiner*—Stephen D Meier
*Assistant Examiner*—Carlos A Martinez, Jr.

(57) ABSTRACT

A fluid reservoir for use in a printing device includes a housing that, at least partially, forms at least one chamber therein. The chamber is configured to hold a fluid. A bubble port leads through housing into a first region of chamber and fluidically couples chamber to atmospheric gas external to housing. A bubble director arranged within chamber is configured to direct at least one bubble of gas from first region to a second region of chamber. The bubble is formed within fluid within first region upon gas entering chamber through bubble port.

18 Claims, 11 Drawing Sheets

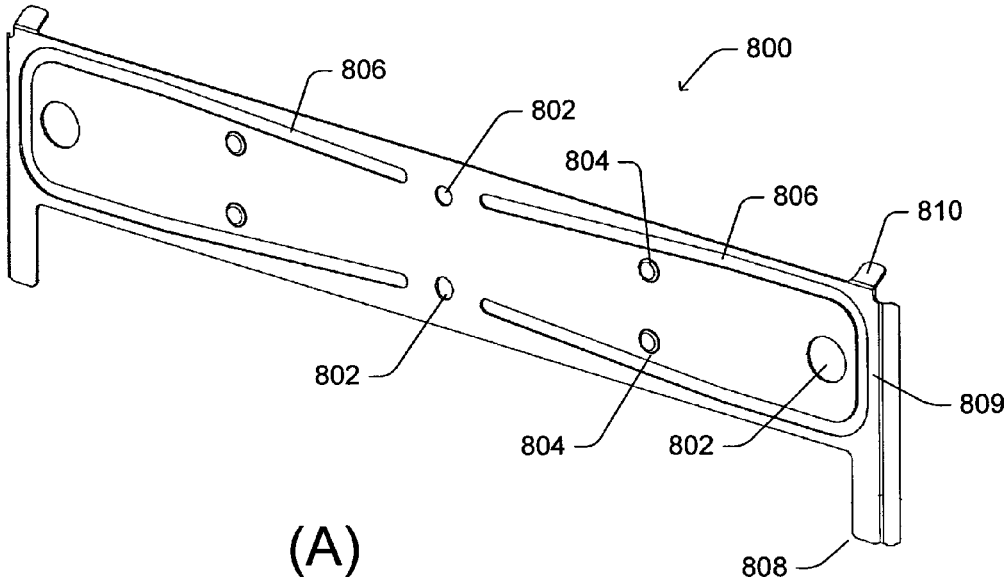
(A)
Fig. 8
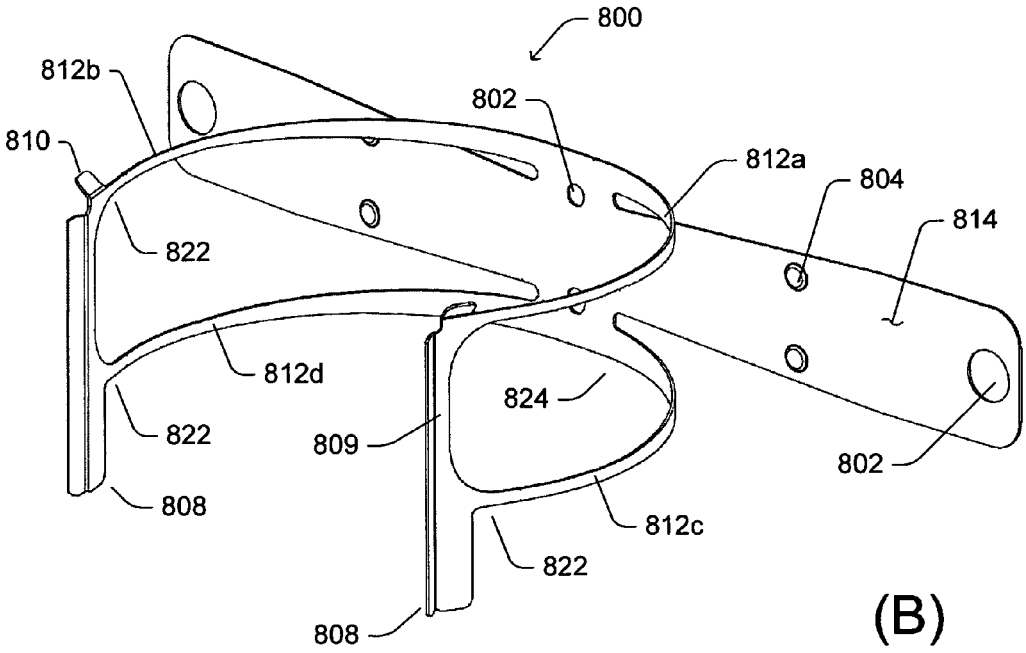
(B)

PRINTING DEVICE FLUID RESERVOIR

BACKGROUND

Some printing devices need to pump or otherwise move inks or other fluids between various components during printing and/or maintenance processes. A fluid reservoir component is often configured to provide the ink or fluid to a fluid ejection mechanism, such as an inkjet printhead. The movement of fluid and air into and out of the fluid reservoir can lead to the formation of froth, which can reduce the effectiveness of the fluid delivery system and possibly affect printing.

Accordingly, there is a desire to design features into the fluid reservoir that allow for adequate fluid/air flow while avoiding, or otherwise reducing, the formation of froth therein.

BRIEF DESCRIPTION OF THE DRAWINGS

The following detailed description refers to the accompanying figures.

DETAILED DESCRIPTION

Figure 1:
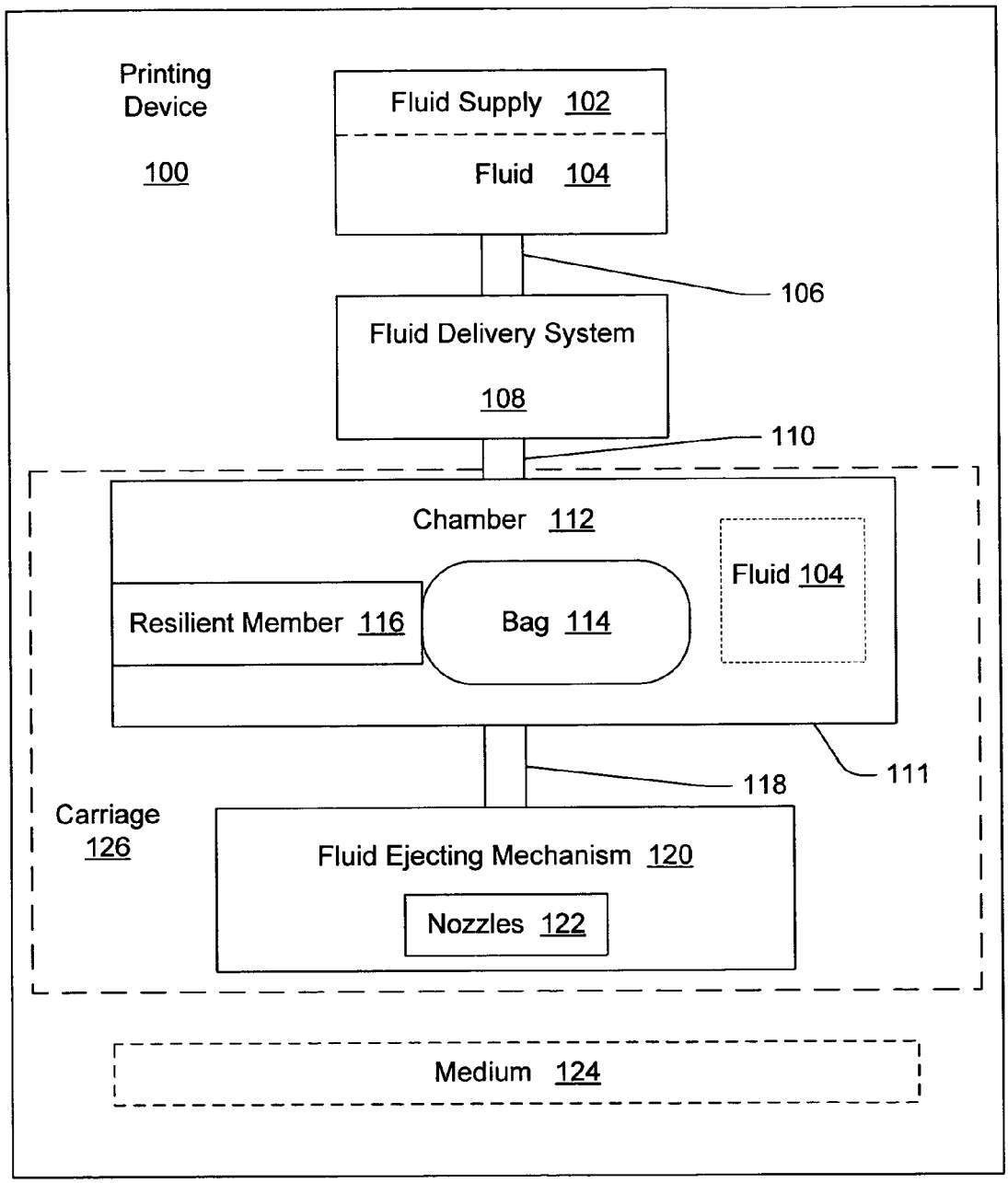
FIG. 1 is a block diagram illustrating certain features of a printing device including fluid reservoir, in accordance with certain exemplary implementations of the present invention.

FIG. 1 is a block diagram illustrating certain features of a printing device 100 including a fluid reservoir 111, in accordance with certain exemplary implementations of the present invention.

Printing device 100 includes a fluid supply 102 containing a fluid 104. Fluid 104 may include, by way of example, a printing related fluid such as an ink, a fixer, etc. Fluid supply 102 is coupled to a conduit 106 that is coupled to a fluid delivery system 108. Fluid delivery system 108 is configured to cause or otherwise allow fluid 104 to move to and from fluid supply 102 through conduit 106. Fluid delivery system 108 is also configured to cause or otherwise allow air and/or air mixed with fluid (e.g., froth) to move to and from fluid supply 102 through conduit 106 at times.

Fluid delivery system 108 is also coupled to a conduit 110 which is further coupled to fluid reservoir 111. Fluid delivery system 108 is configured to cause or otherwise allow fluid 104 to move to and from fluid reservoir 111 through conduit 110. Fluid delivery system 108 is also configured to cause or otherwise allow air and/or air mixed with fluid to move to and from fluid reservoir 111 through conduit 110 at times.

Those skilled in the art will recognize that fluid delivery system 108 may include one more pumps, valves or other like mechanisms and/or controls (not shown).

In this example, fluid reservoir 111 includes a chamber 112 that is configured to hold fluid 104 received through conduit 110. Within chamber 112 are at least one inflatable bag 114 and a resilient member 116 that together provide a bag/spring accumulator that helps to maintain a desired backpressure within chamber 112.

Fluid reservoir 111 is further coupled to a conduit 118, which is further coupled to a fluid ejecting mechanism 120. During printing, fluid 104 within chamber 112 is selectively drawn by fluid ejecting mechanism 120 through conduit 118. Fluid 104 drawn into fluid ejecting mechanism 120 is then selectively ejected through one or more nozzles 122, for example, onto a print medium 124.

Fluid 104 that is not ejected may be returned to fluid supply 102 along with any air, for example, by the action of fluid delivery system 108 via conduit 118, through fluid reservoir 111, through conduit 110, and through conduit 106 to fluid supply 102. In this manner, fluid 104 may be circulated and/or re-circulated though printing device 100, and/or air removed.

In this example, conduits 110 and 118 may each include one or more conduits.

As further illustrated in FIG. 1, fluid reservoir 111, conduit 118 and fluid ejecting mechanism 122 may be arranged on a carriage 126 that moves with respect to medium 124.

Figure 2:
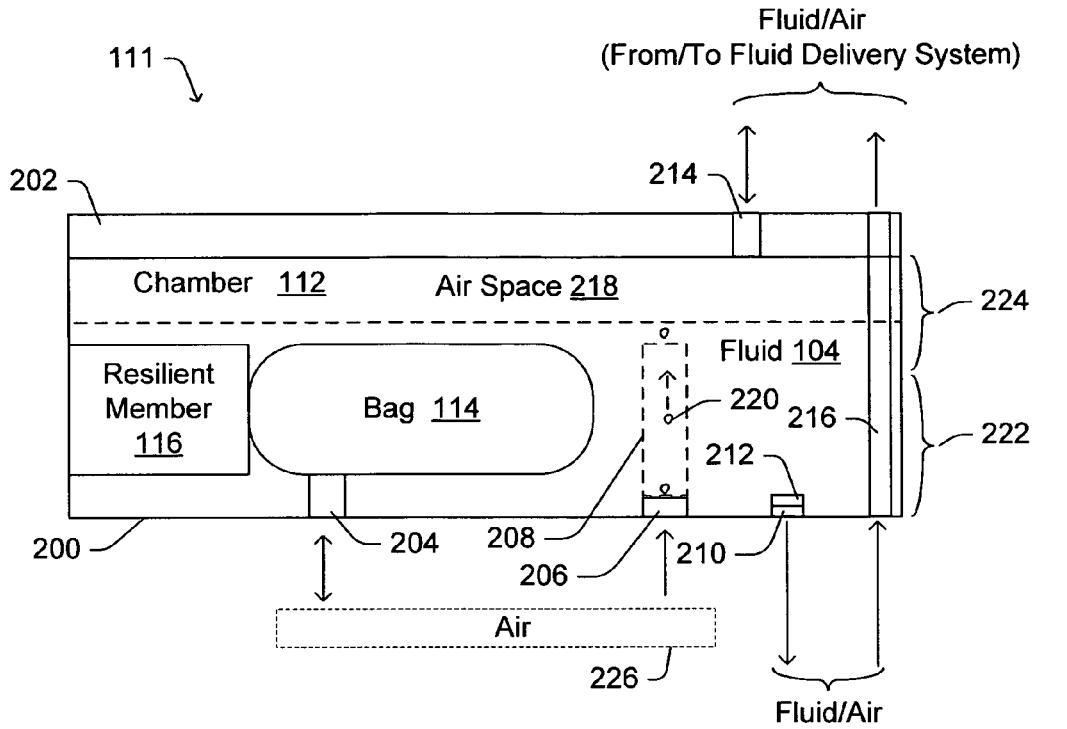
FIG. 2 is a block diagram illustrating certain additional features of a fluid reservoir, in accordance with certain exemplary implementations of the present invention.

Attention is now drawn to FIG. 2, which is a block diagram illustrating certain additional features of fluid reservoir 111. Here, fluid reservoir includes a housing 200. A crown 202 is attached to housing 200, such that housing 200 and crown 202 form chamber 112. As in FIG. 1, chamber 112 includes bag 114 and resilient member 116. Bag 114 includes a fitment 204 that fluidically couples the interior of bag 114 to the atmosphere external to reservoir 111, represented by external air 226. Air 226 may change the volume occupied by bag 114 within chamber 112 through inflation and deflation. Resilient member 116 is arranged to contact bag 114 and to apply compressive force to bag 114.

Within chamber 112 there is a bubble port 206 that is configured to allow external air 226 to enter into chamber 112 when a pressure difference between the external atmospheric pressure and the backpressure within chamber 112 reaches a threshold level. Air 226 is illustrated entering into chamber 112 an air bubble 220, for example. As shown, air bubble 220 is directed from a first region 222 to a second region 224 within chamber 112 by a bubble director 208.

Here, for example, bubble director 208 is illustrated as directing air bubble 220 from bubble port 206 in first region 222 to second region 224 with air space 218. The introduction of air bubbles into chamber 112 via bubbler port 206, during certain active fluid movement cycles in which fluid is moved into and/or out of chamber 112, may lead to unwanted levels of froth or foam being generated within chamber 112. Bubble port 206 and bubble director 208 are configured to help reduce the development of froth in chamber 112 by directing the air bubbles from first region 222 to second region 224 along a desired path rather than simply allowing the air bubbles to rise freely through fluid 104 at any time.

Those skilled in the art will recognize that the delineation between first region 222 and second region 224 will vary depending upon the design of fluid reservoir 111 and/or the type of fluid being used.

In the example shown in FIG. 2, the exemplary first and second regions are "vertically" oriented with respect to one anther as between port bubbler 206 and air space 218 with bubble director 208 designed to direct the bubbles along a substantially straight path in the vertical direction. In other implementations, the first and second regions may have a different orientation to one another, and/or within the chamber. For example, the regions may have a "horizontal" and/or "diagonal" orientation, and/or a more complex spatial arrangement and the bubble director in such implementations would be designed to direct bubbles along one or more desired paths from the first region to the second region.

As used herein, the term "first region" is defined as a contiguous region of space within a chamber adjacent to a bubble port such that air or gas entering into the chamber through the bubble port enters into the first region and forms a bubble within the first region. The term "second region" as used herein is defined as a region of space within the chamber that is separated from the bubble port by at least the first region.

Hence, bubble 220 is formed within the fluid 104 in the first region 222. Sometime after forming, bubble 220 rises and is forced or otherwise directed by bubble director 208 along a desired path to second region 224.

As shown in FIG. 2, a fluid outlet 210 is configured to allow fluid 104 to pass through to fluid ejecting mechanism 120. Here, a screen or filter 212 is provided over fluid outlet 210. The use of such filters is well known.

A port 214 into chamber 112 is also provided, in this example through crown 202, such that fluid 104 (and/or air) may be introduced into and/or pulled out of chamber 112 by fluid delivery system 108. There is also a fluid bypass 216 that, in this example, extends through housing 200 and crown 202 of fluid reservoir 111 that allows fluid delivery system to pull fluid and/or air from the fluid ejecting mechanism. Bubble port 206 and port 214 may be located at or near the center of chamber, since reservoir 111 may be tilted.

FIGS. 3A-F are diagrams illustrating certain features within chamber 112, in accordance with certain exemplary implementations of the present invention.

Figure 3:
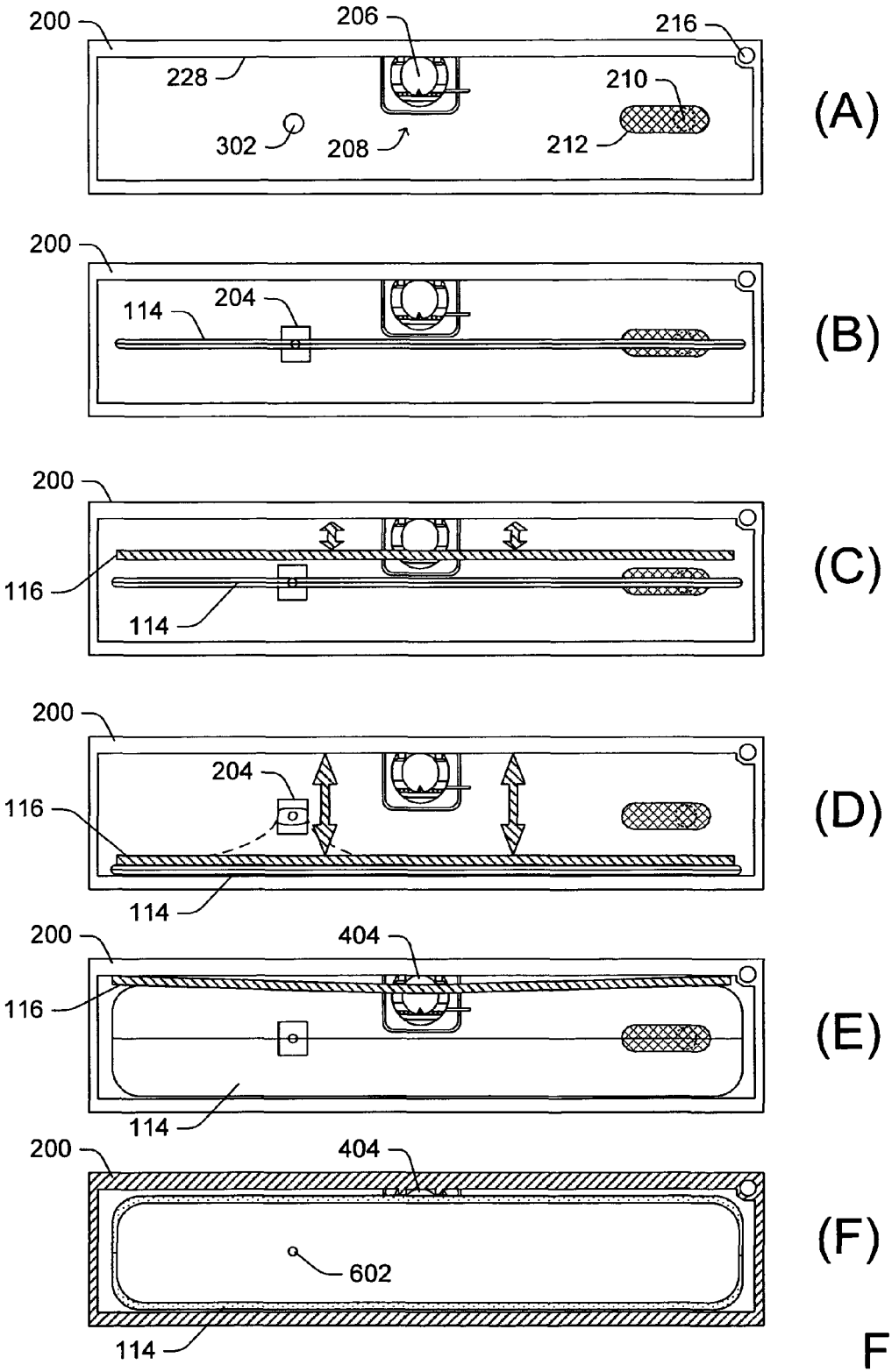
FIG. 3A is a diagram illustrating certain features within a chamber of a fluid reservoir, in accordance with an exemplary implementation of the present invention.
FIG. 3B is a diagram illustrating a bag arranged within the chamber of the fluid reservoir in FIG. 3A, in accordance with an exemplary implementation of the present invention.
FIG. 3C is a diagram illustrating a resilient member arranged within the chamber of the fluid reservoir in FIG. 3B, in accordance with an exemplary implementation of the present invention.
FIG. 3D is a diagram illustrating the resilient member arranged within the chamber of the fluid reservoir in FIG. 3C with the bag deflated and compressed, in accordance with an exemplary implementation of the present invention.
FIG. 3E is a diagram illustrating the resilient member arranged within the chamber of the fluid reservoir in FIG. 3C with the bag significantly inflated, in accordance with an exemplary implementation of the present invention.
FIG. 3F is a cross-sectional view diagram illustrating a portion of the bag within the chamber of the fluid reservoir in FIG. 3E, in accordance with an exemplary implementation of the present invention.

FIG. 3A shows a view into the chamber portion provided by housing 200 prior to installing bag 114, resilient member 116 and attaching crown 202. As shown, bubble director 208 is arranged at least partially along inner wall surface 228 of housing 200 above bubble port 206. Fluid outlet 210 (in dashed line) is covered by filter 212. Fluid bypass 216 extends through housing 200. A port 302 extends through the floor of housing 200.

In the examples illustrated herein, port 302 and/or bubble port 206 may also include a labyrinth or other like feature (not shown), as is well known.

In FIG. 3B bag 114 is coupled to port 302 using fitment 204. In FIG. 3C resilient member 116 is arranged between inner wall surface 228 and bag 114. The arrows associated with resilient member 116 in these drawings are intended to illustrate the expanding/compressive force provided by resilient member 116 between inner wall surface 228 and the side of bag 114 in contact with resilient member 116. Thus, for example, in FIG. 3D bag 114 is deflated enough such that the force of resilient member 116 on bag 114 has pushed bag 114 across chamber 112. To the contrary, when bag 114 is inflated, as illustrated in FIG. 3E, resilient member 116 is pushed back (compressed) by bag 114. In this example, bag 114 is illustrated as being fully inflated and resilient member 116 fully compressed.

As shown, when fully compressed part of resilient member 116 contacts part of bubble director 208. Even with such contact, bubble director 116 maintains a path 404 between the first and second regions. Indeed, in this example, path 404 is actually at least partially enclosed by resilient member 116. As illustrated using a cross-sectional view in FIG. 3F, part of bag 114 also contacts part of bubble director 208. Again, even with such contact, bubble director 208 maintains a path 404 between the first and second regions. Path 404 may therefore be at least partially enclosed by bag 114.

Note that in FIG. 3F, bag 114 is illustrated as being opaque such that only a bag opening 602 corresponding to fitment 204 and port 302 is visible in this cross-sectional view.

Figure 4:
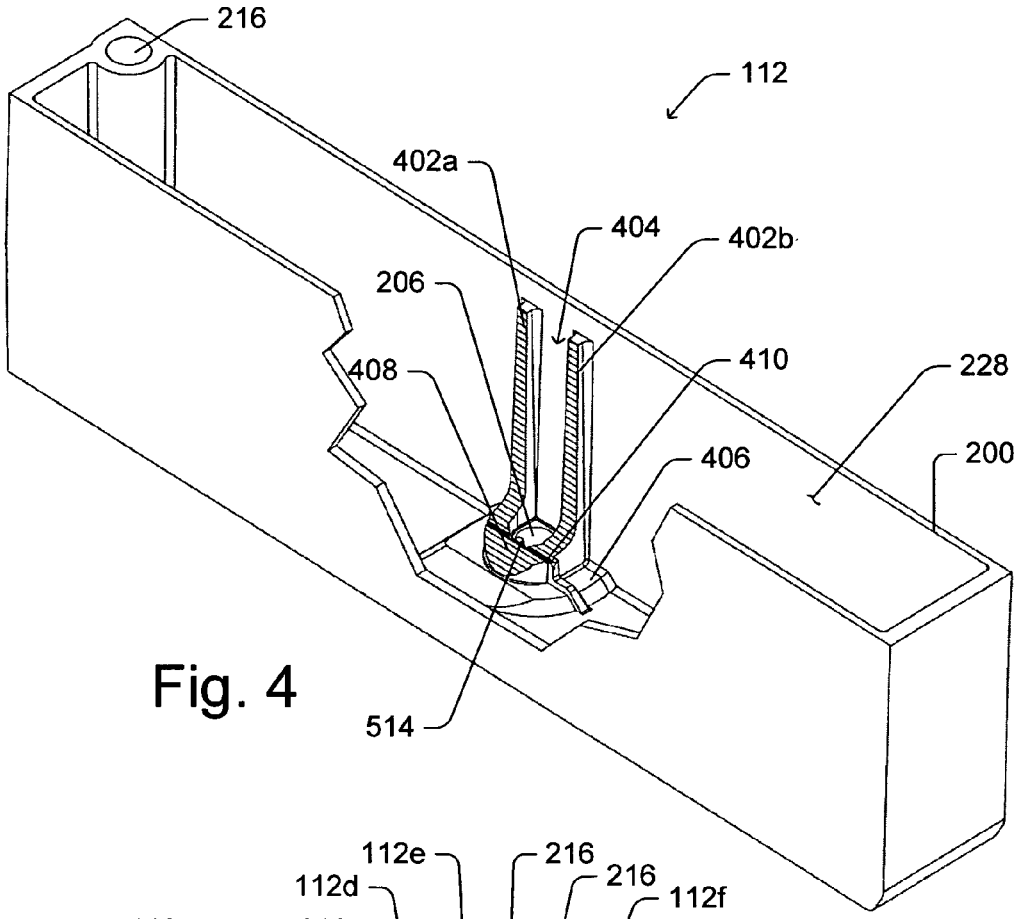
FIG. 4 is an isometric diagram illustrating certain features of a fluid reservoir in more detail, in accordance with certain exemplary implementations of the present invention.

Attention is now drawn to FIG. 4, which is an isometric diagram illustrating certain features of exemplary bubble director 208 in more detail.

In this example, bubble director 208 includes two guides 402*a-b* that extend outwardly from inner surface wall 228 and define path 404. Guides 402*a-b* tend to direct bubbles that enter through bubble port 206 along path 404. Here, path 404 is not fully enclosed until such time as contact occurs between part of resilient member 116 and/or bag 114, e.g., as illustrated in FIGS. 3E-F, respectively.

In other implementations, one or more guides 402 may be used. In still other implementations, all or part of a guide 404 may be fully enclosed at all times.

Guides 402 may also provide a capillary function when reservoir 111 is inverted that allows bubble port 206 to stay wetted longer In FIG. 4, bubble director 208 further includes a base 408 between guides 402*a-b*. In this example, base 408 extends at least part of the way around and outwardly from bubble port 206. Base 408 is also contoured in this example. Here, the contour of base 408 allows for a more conforming fit with the side of bag 114 when it comes into contact with bubble director 208. The contour of base 408 may also be designed to help direct bubbles along and/or towards path 404, reduce the size of the first region, and/or help to keep bubble port 206 wetted (e.g., by holding some fluid next to bubble port 206 should reservoir 111 be inverted for time to time).

In this example, base 408 is separated from the bottom or floor surface of the chamber by a stage 406. For example, stage 406 may be needed to help form and/or support certain features of bubble port 206.

In certain implementations, bubble port 206 includes a ball that fits into a shaped opening. To function properly the interface between the ball and the opening's wall should be maintained in a wetted condition (i.e., wet with fluid). As shown in FIG. 4, to help further help maintain bubble port in a wetted condition, at least one capillary feature 410 may be provided to allow fluid to move past stage 406 and/or base 408. Here, capillary feature 410 extends through at least a part of base 408 as a groove therein and onto and over stage 406 as a protrusion into chamber 112 that contacts the floor surface. In this manner, capillary feature 410 is configured to draw fluid through capillary action to bubble port 206.

In the example shown in FIG. 4, base 408 also includes a notch feature 514 that extends part way out and over bubbler port 206. Notch feature 514 in this example is configured to further assist capillary feature 410 in wetting bubble port 206. Notch feature 514 may also be configured to further support the bubble directing feature provided by bubble director 208.

Figure 5A:
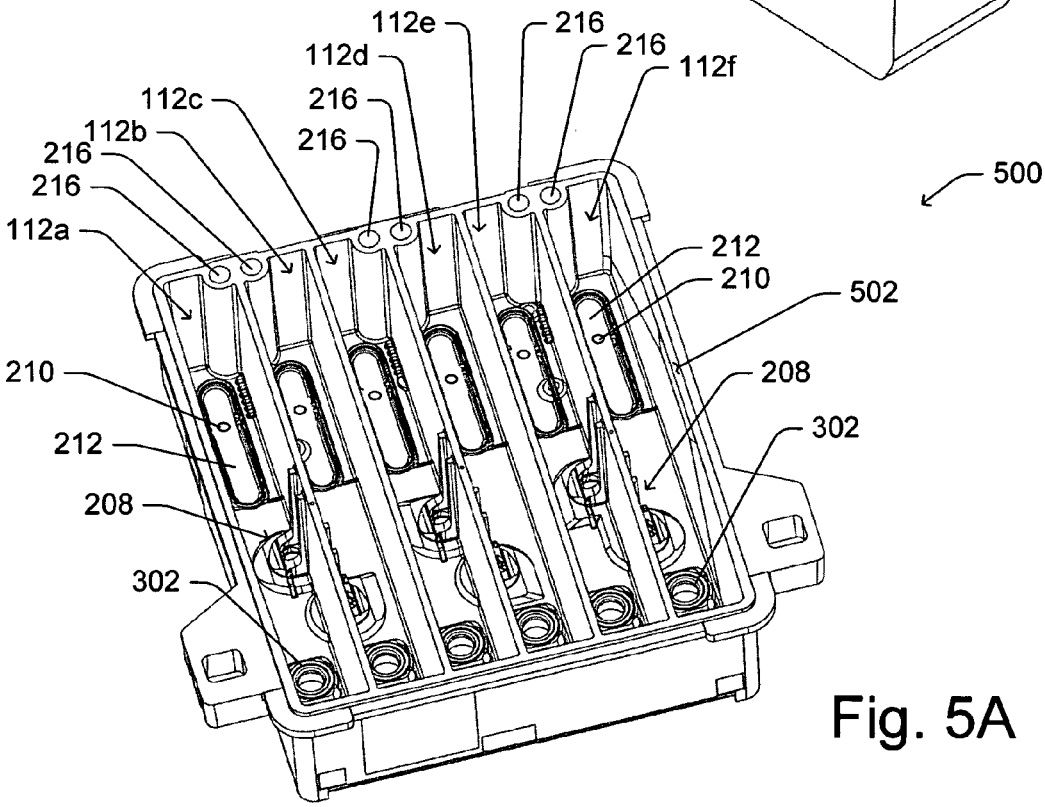
FIG. 5A is an isometric diagram illustrating certain features of a multiple chamber fluid reservoir, in accordance with certain exemplary implementations of the present invention.

Attention is now drawn to FIG. 5A, which is an isometric diagram illustrating certain features of a multiple chamber fluid reservoir housing 500, in accordance with certain further exemplary implementations of the present invention.

Housing 500 partially defines six separate chambers 112*a-f*, similar to those illustrated in FIGS. 3A-F and 4. Here, for example, when used in a multiple color inkjet printer, each chamber 112*a-f* may be filled with a different color and/or type of ink.

Figure 7:
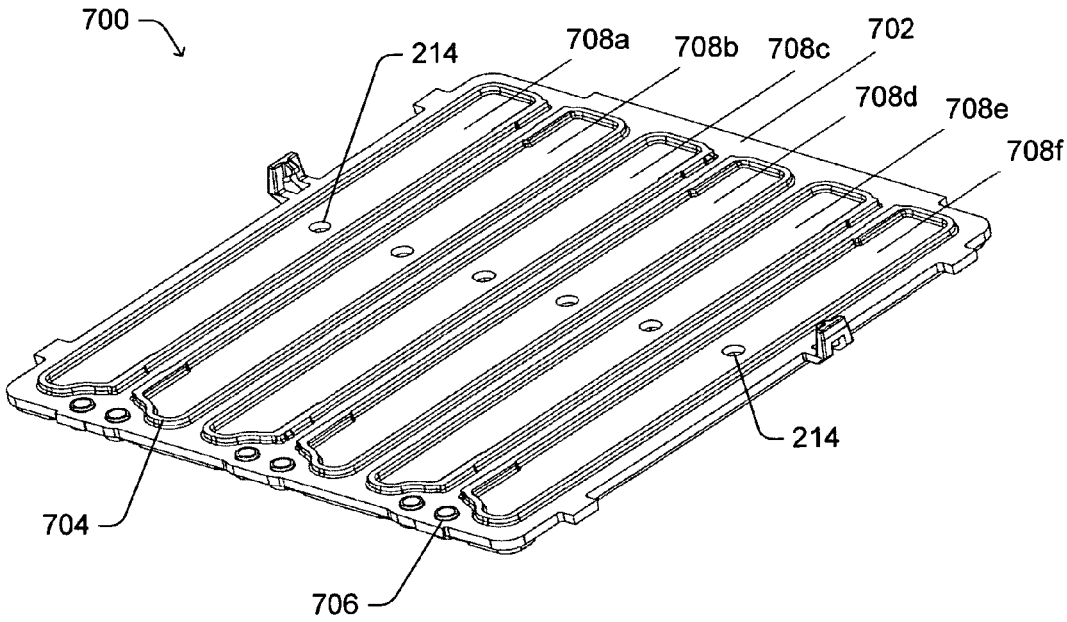
FIG. 7 is an isometric diagram illustrating certain features of a crown that attached to the multiple chamber fluid reservoir of FIG. 5A, in accordance with certain exemplary implementations of the present invention.

Housing 500 includes an edge 502 is provided to attach to and/or otherwise mate with a corresponding surface 702 of a crown 700, such as shown in FIG. 7. In this example, housing 500 and crown 700 are formed of plastic and edge 502 and surface 702 are designed to be sealed together as result of thermal energy applied thereto. Those skilled in the art will recognize that other materials may be used to form housing 500 with crown 700 and/or other methods may be used to attach housing 500 and crown 700.

Figure 5B:
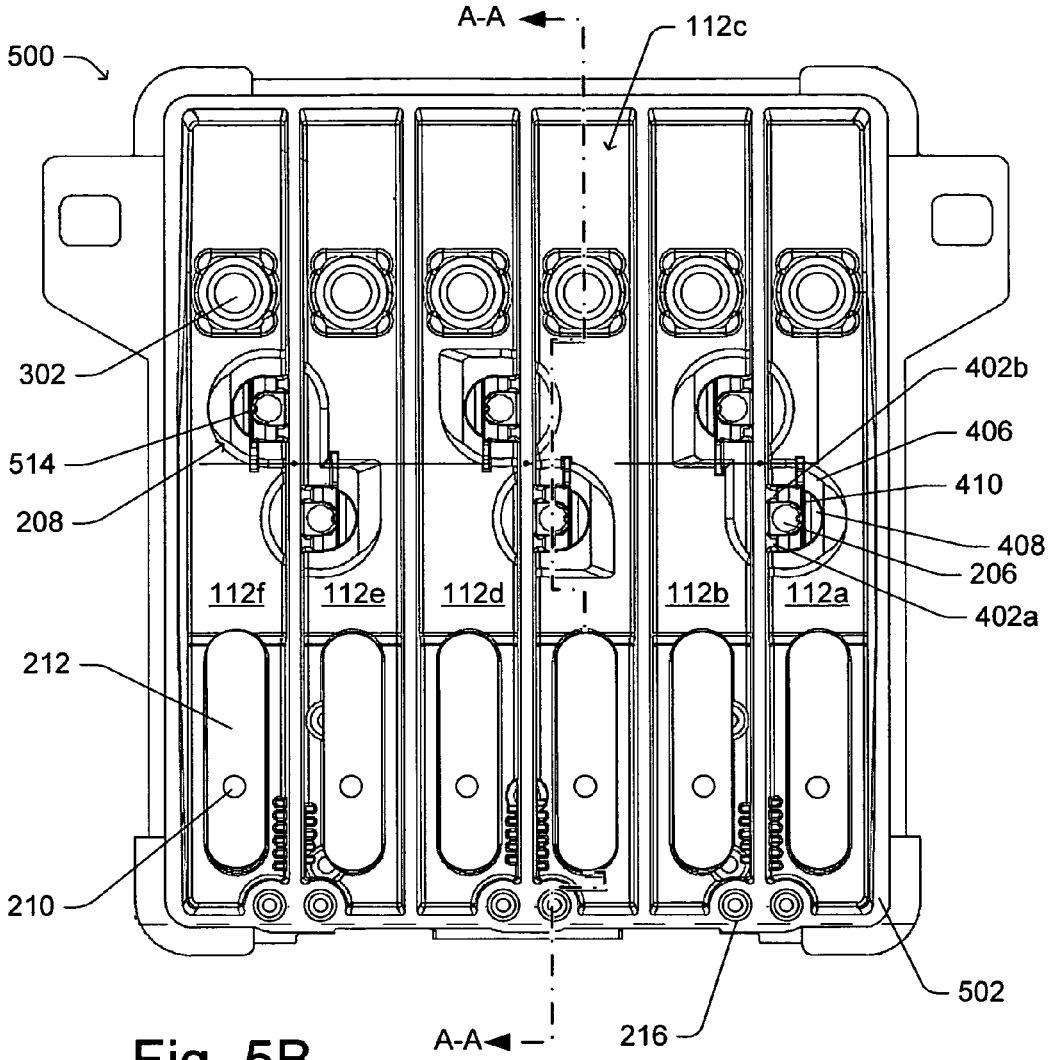
FIG. 5B is a top view diagram illustrating certain features within the multiple chamber fluid reservoir of FIG. 5A, in accordance with certain exemplary implementations of the present invention.

FIG. 5B is a top view diagram further illustrating features within the multiple chamber fluid reservoir housing 500. Here, for example, filter 212 is illustrated here as being transparent.

Figure 5C:
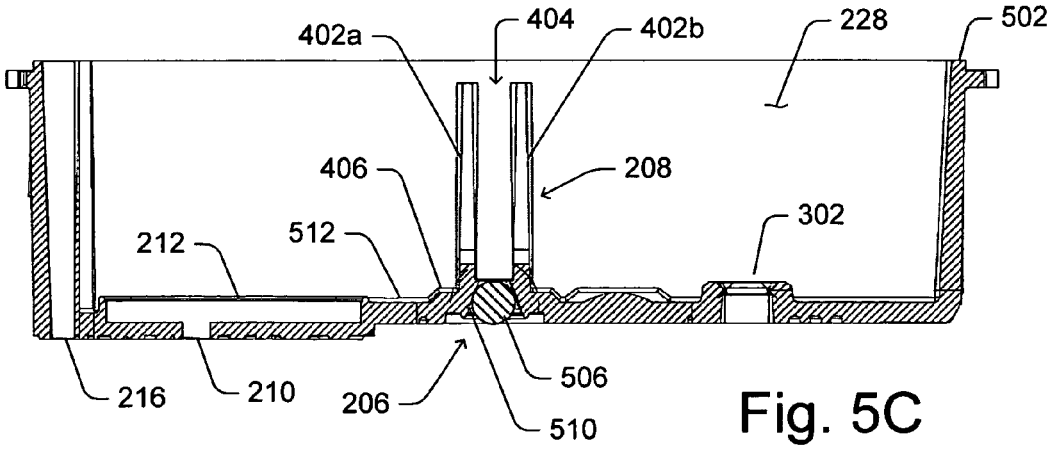
FIG. 5C is a cross-sectional diagram illustrating certain features within the multiple chamber fluid reservoir of FIG. 5B at line A-A, in accordance with certain exemplary implementations of the present invention.

FIG. 5C is a cross-sectional diagram illustrating some of the features within the multiple chamber fluid reservoir housing 500 of FIG. 5B at line A-A. Here, ball 506 is shown as being arranged in bubble port 206 in contact with a wall 510 having a desired shape that promotes bubble formation.

Bubble port 206 (before the ball is installed) may be used to initially fill chamber 112 with fluid, for example, during manufacture. This process is easier because the bag is collapsed and there is a lot of space for fill.

Figure 5D:
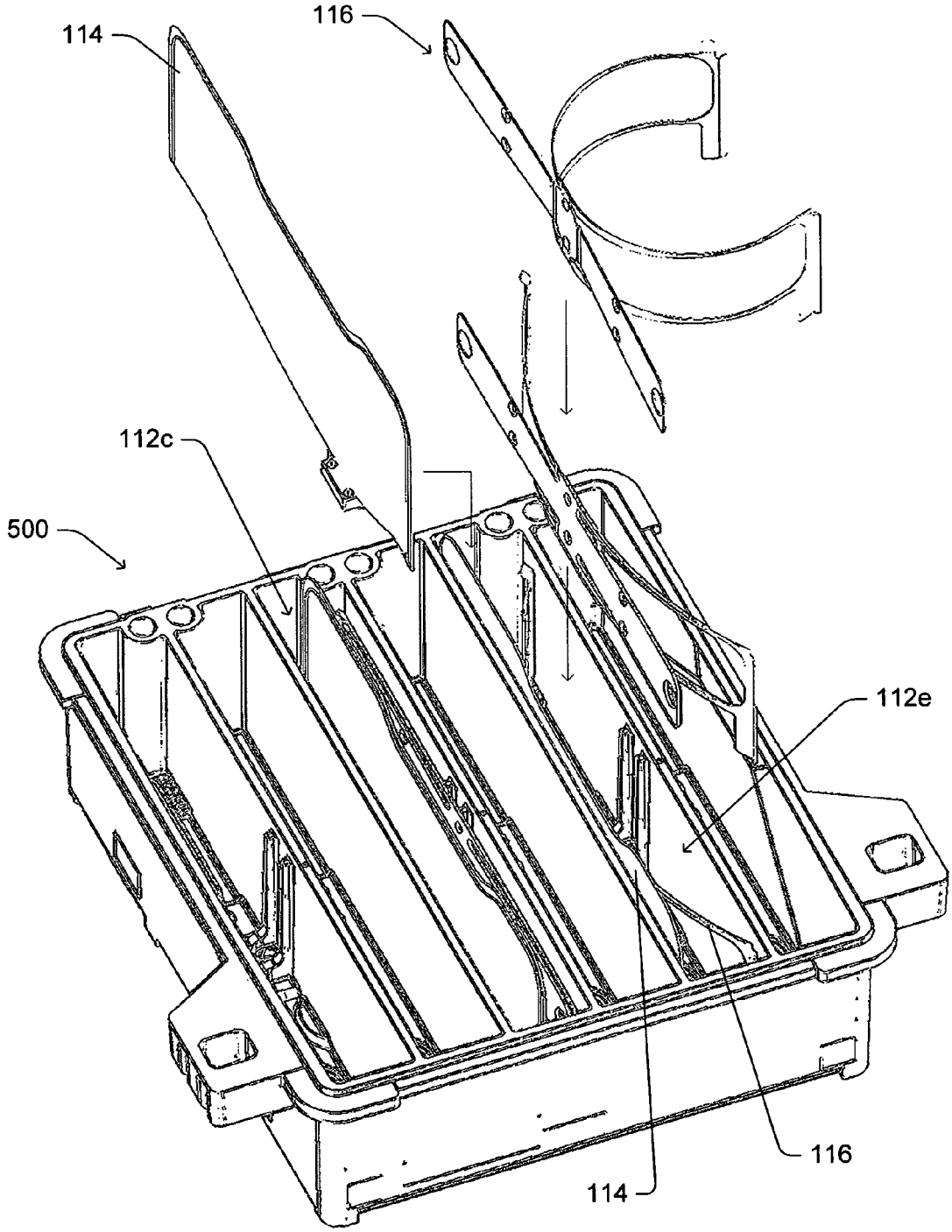
FIG. 5D is an isometric diagram illustrating certain assembled features of a multiple chamber fluid reservoir including the insertion of a bag and spring therein, in accordance with certain exemplary implementations of the present invention.

FIG. 5D is an isometric diagram illustrating multiple chamber fluid reservoir housing 500 during and after insertion of bag 114 and resilient member 116 (shown as a spring) therein, in accordance with certain exemplary implementations of the present invention. As illustrated by the directional arrows, bag 114 is installed in chamber 112*e*, for example by coupling fitment 204 with port 302. The spring (116) is then compressed and inserted in chamber 112*e* between bag 114 and the inner wall surface.

In one example, chamber 112 is about 10 mm wide, 22 mm high and 80 mm long, and has an internal volume of about 15 cc. Bag 114 occupies about 9 cc when fully inflated. When deflated bag 114 occupies about 2 cc. Thus, bag 114 can displace about 7 cc of fluid 104. Bag 114 is inserted in a deflated state into chamber 112.

Bag 114 may be shorter than a length of chamber 112, but taller than a height of chamber 112. When inflated, bag 114 touches ceiling surface 708 of the crown 700. Because bag 114 touches ceiling surface 708, part of the volume of chamber 112 is occupied by bag rather than fluid. This tends to reduce the variation in fluid volume if reservoir 111 is tilted.

Attention is drawn next to FIGS. 10A-D, which are diagrams illustrating certain techniques for forming a bag 114, in accordance with certain exemplary implementations of the present invention.

Figure 10:
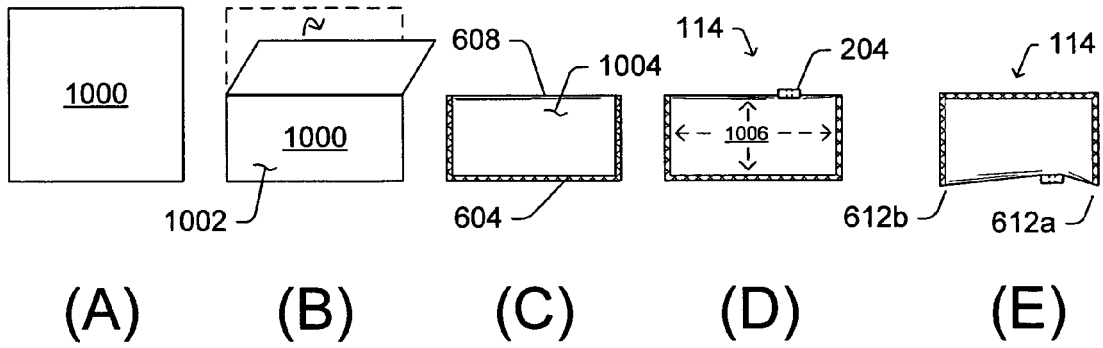
FIGS. 10A-D are diagrams illustrating certain techniques for forming a bag, in accordance with certain exemplary implementations of the present invention.
FIG. 10E is a diagram illustrating certain features of an inflated bag, as in FIG. 10D, in accordance with certain exemplary implementations of the present invention.

In FIG. 10A, a film or sheet 1000 of an air impermeable material is shown. Sheet 1000 may take varying shapes depending on the design of reservoir 111. Sheet 1000 may include one or more layers of plastic and/or other like materials.

In FIG. 10B, sheet 1000 is being folded in some manner such that at least a portion of a first side surface 1002 is brought into contact with itself. In FIG. 10C, a second side surface 1004 is shown as forming an outer surface. Sheet 1000 now has a fold 608. The sheet is also joined together at a seam 604. For example, portions of first side surface 1002 may be heat bonded or otherwise attached together to form seam 604.

Seam 604 in this example is contiguous and defines an interior 1006 of an inflatable bag 114 opposite fold 608, as illustrated in FIG. 10D. Fitment 204 is heat bonded or otherwise attached to sheet 1000 along or near to fold 608. A bag opening 602 (see FIG. 3F and FIG. 6B) extends through fitment 204 and through sheet 1000 into interior 1006. In certain implementations, fitment 204 is attached to sheet 1000 and bag opening 602 created prior folding the sheet.

FIG. 10E is a diagram illustrating certain features of the exemplary bag 114 of FIG. 10D inflated to a certain volume with air. in this example, sheet 1000 includes materials that are substantially inelastic. Thus, as bag 114 inflates with air the shape of bag 114 and placement of fitment 204 along fold 608 causes a first end 612*a* and second end 612*b* to extend outwardly (as illustrated downwardly) from fitment 204. In certain implementations, bag 114 is configured such that ends 612*a* and/or 612*b* hold bag 114 off of the floor surface of the housing to keep bag 114 from interfering (e.g., blocking) filter 212.

Figure 6:
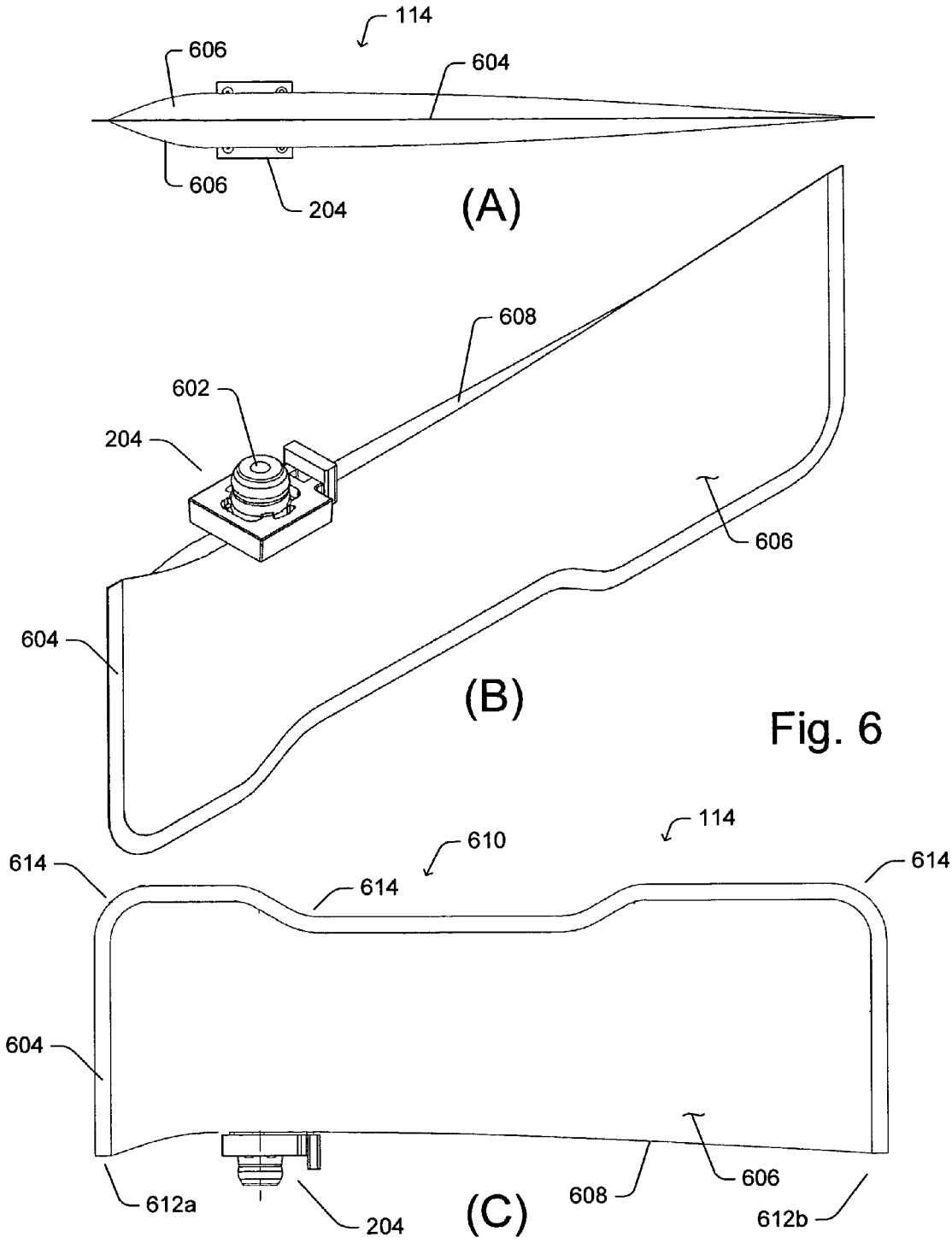
FIG. 6A is a top view diagram illustrating certain features of a bag as in FIG. 5D, in accordance with certain exemplary implementations of the present invention.
FIG. 6B is an isometric diagram illustrating certain features of a bag as in FIG. 5D, in accordance with certain exemplary implementations of the present invention.
FIG. 6C is a side view diagram illustrating certain features of a bag as in FIGS. 6A-B, in accordance with certain exemplary implementations of the present invention.

FIG. 6A is a top view diagram illustrating certain features of a bag 114 shaped as in FIG. 5D, in accordance with certain exemplary implementations of the present invention.

Bag 114 has a tapered profile from this view and includes seam 604 and outer surface 606. Fitment 204 is attached along the fold as illustrated in the isometric diagram of FIG. 6B. Bag opening 602 extends through fitment 204 and into the interior of bag 114.

As further illustrated in the side view diagram of FIG. 6C, seam 604 includes several non-straight or curved portions 614, some of which create an indention 610. Indention 610, for example, may be configured to prevent bag 114 from blocking or otherwise interfering with other features of fluid reservoir 111. In this example, indention 610 prevents bag 114 from interfering with port 214.

FIG. 7 is an isometric diagram illustrating certain features of crown 700 that may be attached to the multiple chamber fluid reservoir housing 500 of FIG. 5A, for example, as previously described.

For each chamber 112 in housing 500, crown 700 has a corresponding port 214 and fluid bypass opening 706 extending there through. Ridges 704 define chamber ceiling surfaces 708*a-f*, which correspond to chambers 112*a-f* of housing 500, respectively. Ridges 704 may be used to provide proper alignment and/or sealing of crown 700 to housing 500.

Figure 8:
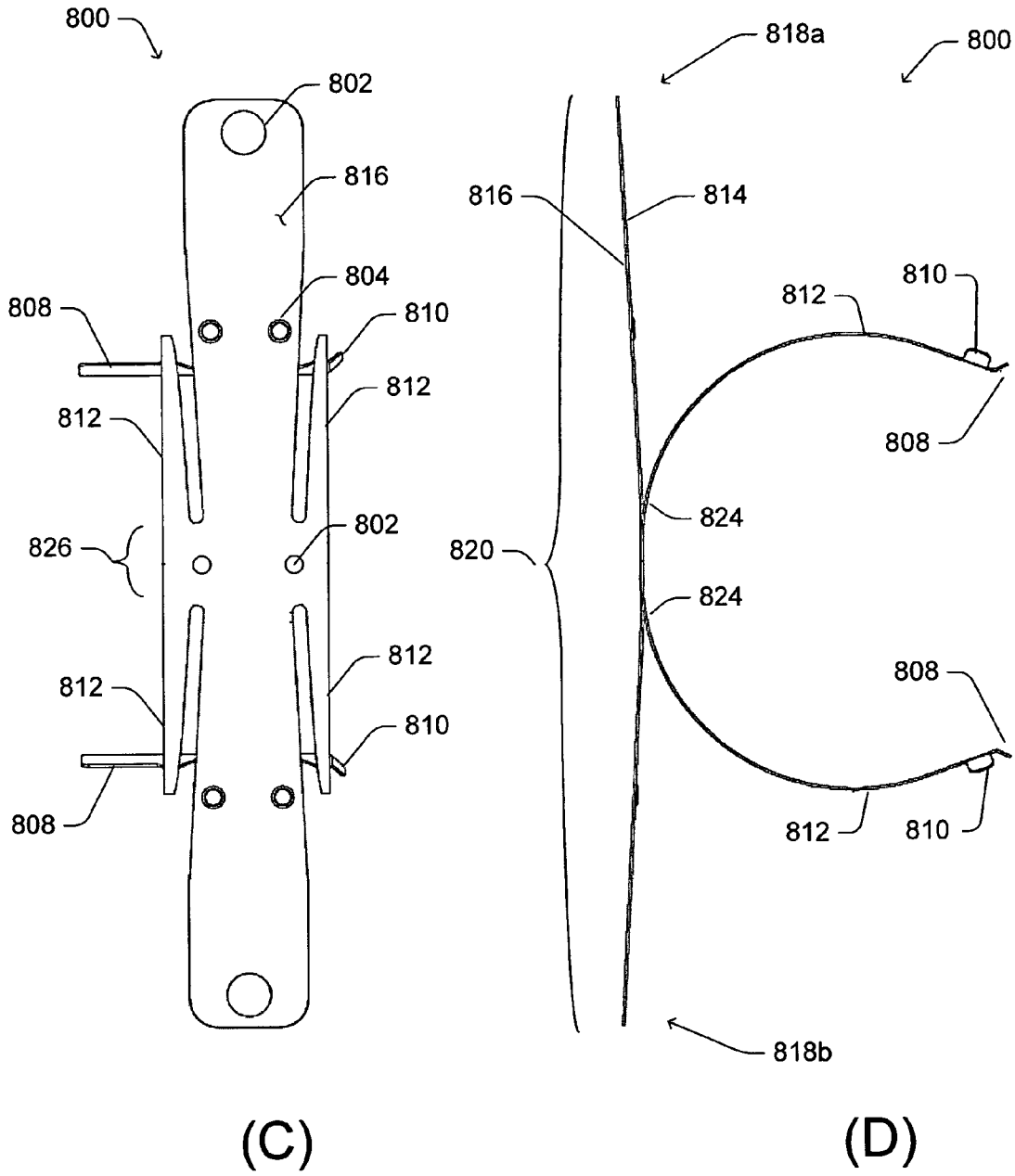
FIGS. 8A-B are isometric diagrams illustrating certain features of a spring as in FIG. 5D, in accordance with certain exemplary implementations of the present invention.
FIG. 8C is a front view diagram further illustrating the spring as in FIGS. 8A-B, in accordance with certain exemplary implementations of the present invention.
FIG. 8D is a top side view diagram further illustrating the spring as in FIGS. 8A-B, in accordance with certain exemplary implementations of the present invention.

Attention is drawn now to FIGS. 8A-B, which are isometric diagrams illustrating certain features of a resilient member 116 in the form of a spring 800, in accordance with certain exemplary implementations of the present invention.

In FIG. 8A, a stamped and partially formed unitary piece of material is shown prior to being shaped to be resilient as desired. In certain implementations, spring 800 is formed of metal material such as a stainless steel or other alloy. By way of example, in certain implementations spring 800 is made using "301 Stainless Steel" that is about 0.16 mm thick and has a minimum tensile strength of about 1,380 MPa (about 200,000 psi). In other implementations, other non-metallic materials (e.g., plastic, etc.) may be used to form all or part of a resilient member 116 having this and/or other shapes.

Spring 800 is shown as having a plurality of holes 802 and dimples 804, which are used to assist with the machining and/or manufacturing process. Accordingly, other implementations may have more, less, or no holes or dimples.

In this example, two slots 806 are formed by removing part of the material. As shown and described in more detail below, this exemplary slot 806 defines a beam portion and a plurality of leg portions. Also formed at this stage are two feet 808, two bridges 809 and two toes 810. Feet 808 and toes 810, which are shaped and bent protruding portions, are configured to position spring 800 within chamber 112. Feet 808 and bridge 809 are also configured (e.g., bent) to more easily slide along inner wall surface 228. One bridge 809 connects two legs together and is configured in this example to ease installation of spring 800 into chamber 112.

In FIG. 8B, spring 800 has been shaped to be resilient as desired. As shown in this example four curved legs 812*a-d* extend outwardly from a center area in a direction away from inner surface 814. Each leg 812*a-d* has a proximate end 824 and a distal end 822, and each leg portion 812*a-d* is tapered between the proximate and distal ends. The tapered shape of legs 812*a-d* is configured to allow spring 800 to provide a substantially consistent amount of force while operating in constrained region of chamber 112. Because the center of pressure of bag 114 is not in the center of the spring, in this example, legs 812*c-d* are slightly wider than legs 812*a-b*. This tends to reduce tilting of spring 800 as is moves in chamber 112.

As shown bridge 809, which is optional, connects two legs at their distal ends 822.

FIG. 8C is a front view diagram further illustrating spring 800. Here, center area 826 is shown. From this view point, it can be seen that toes 810 and feet 808 extend outwardly to maintain the spring's position within chamber 112. For example, toes 810 may slidably contact ridge 704 of crown 700, and feet 808 may slidably contact floor surface 512 of housing 500 to maintain spring 800 in position. An outer surface 816 is shown in this view.

FIG. 8D is a top side view diagram of spring 800. This drawing illustrates that a beam portion 820 is provided and connected in the center area to proximate ends 824 of legs 812. Beam portion 820 includes ends 818*a* and 818*b*. In this example, beam portion 820 has been shaped to be resilient such that ends 818*a* and 818*b* each extend outwardly from the center area in a direction away from of the outer surface 816. The resilient shape of beam portion 820 is configured to allow for a more even compressive force to be applied by spring 800 across the length of beam portion 820 and bag 114.

Figure 9:
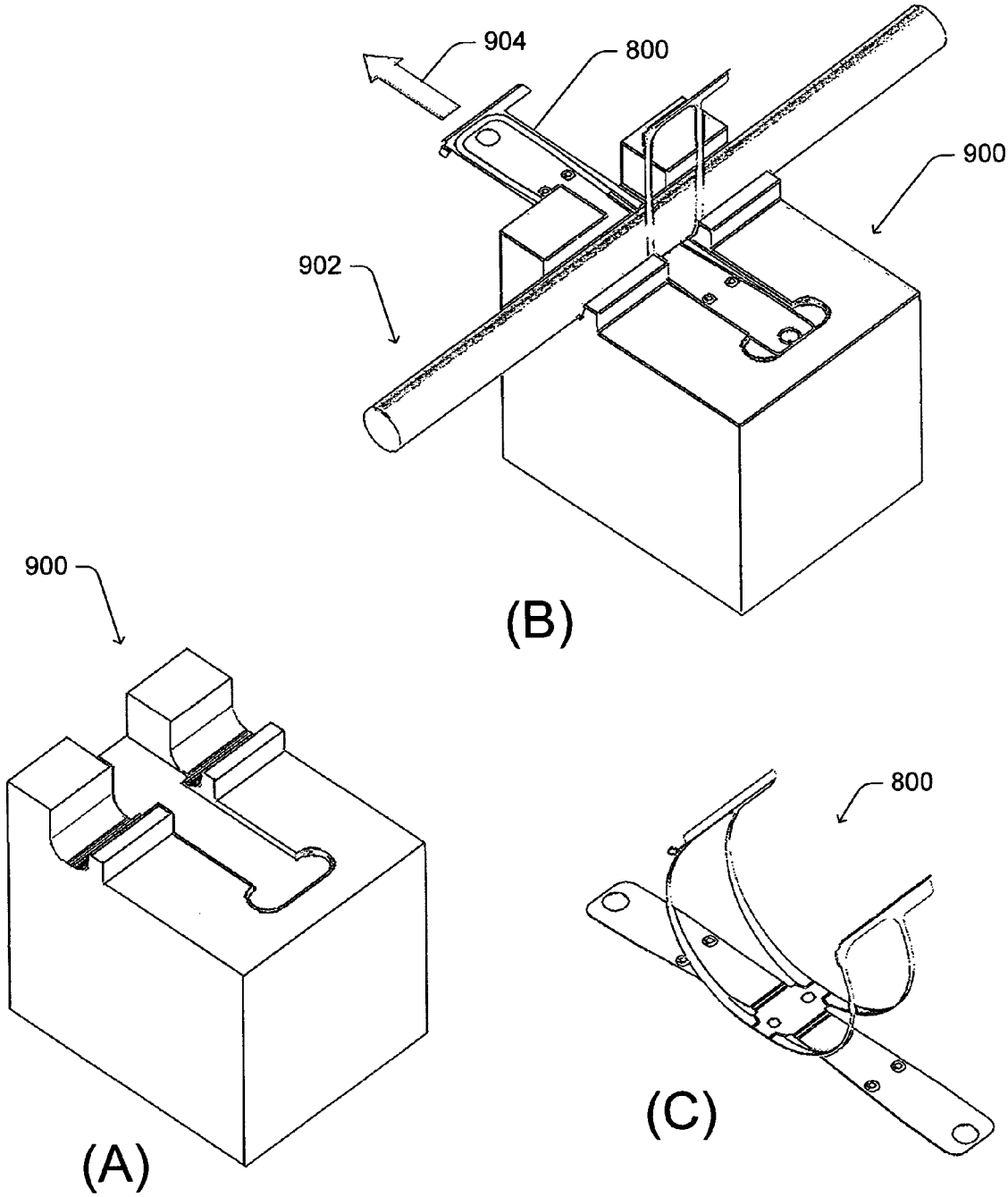
FIGS. 9A-C are isometric diagrams illustrating certain techniques for forming a spring as in FIGS. 8A-D, in accordance with certain exemplary implementations of the present invention.

FIGS. 9A-C illustrate one technique for shaping the legs 812 of spring 800 to be resilient, in accordance with certain exemplary implementations of the present invention. Spring 800, in this example, may be referred to as a constant-stress/constant-radius cantilever beam spring. The legs may be shaped using a form or tool 900 as in FIG. 9A. As shown in FIG. 9B, a fist half of spring 800 (e.g., flat as in FIG. 8A) is inserted into tool 900 followed by a mandrel 902. As shown, the tool and mandrel compressively contact the leg portions, but not the beam portion. A pulling force represented by arrow 904 is then applied to spring 800 that causes the leg portions to bend and become resilient as it is conformed by tool 900 and mandrel 902. The process is then repeated for the other half of spring 800. The resulting unitary member, parabolic cantilever beam spring 800 is shown in FIG. 9C.

Although the above disclosure has been described in language specific to structural/functional features and/or methodological acts, it is to be understood that the appended claims are not limited to the specific features or acts described. Rather, the specific features and acts are exemplary forms of implementing this disclosure.

What is claimed is:

1. A fluid reservoir for use in a printing device comprising:

a housing at least partially forming at least one chamber therein that is configured to hold a fluid;

an inflatable bag arranged within said chamber;

a resilient member arranged within said chamber and configured to compressively contact said inflatable bag;

a bubble port leading through said housing into a first region of said chamber and fluidically coupling said chamber to atmospheric gas external to said housing; and a bubble director arranged within said chamber at least partially along an inner wall surface of said housing above said bubble port and configured to direct at least one bubble of said gas from said first region to a second region of said chamber, said bubble being formed within said fluid within said first region upon said gas entering said chamber through said bubble port, wherein said bubble director maintains a path between said first and second regions, and said path is at least partially enclosed by said inflatable bag and said resilient member when said inflatable bag is fully inflated and said resilient member is fully compressed.

2. The fluid reservoir as recited in claim 1, wherein said housing further includes a port leading through said housing, and said inflatable bag having a fitment fluidically coupled to receive said gas through said port.

3. The fluid reservoir as recited in claim 1, wherein said resilient member is arranged between said inflatable bag and said bubble director.

4. The fluid reservoir as recited in claim 3, wherein said resilient member is arranged between an outer surface of said inflatable bag and said inner wall surface of said housing.

5. The fluid reservoir as recited in claim 1, wherein said bubble director is integrally formed as part of said housing.

6. The fluid reservoir as recited in claim 1, said bubble director comprising at least one guide on said inner wall surface extending from said first region to said second region, said path of said bubble director formed along said at least one guide.

7. The fluid reservoir as recited in claim 6, wherein said guide is configured to contact a portion of said resilient member when said resilient member is fully compressed and thereby prevent said portion of said resilient member from contacting at least a portion of said inner wall surface located adjacent said guide.

8. The fluid reservoir as recited in claim 7, wherein, when in contact, said guide and said portion of said resilient member form at least part of said path of said bubble director.

9. The fluid reservoir as recited in claim 6, wherein said guide is configured to contact a portion of said inflatable bag when said inflatable bag is fully inflated and thereby prevent said portion of said inflatable bag from contacting at least a portion of said inner wall surface located adjacent said guide.

10. The fluid reservoir as recited in claim 9, wherein, when in contact, said guide and said portion of said inflatable bag form at least part of said path of said bubble director.

11. The fluid reservoir as recited in claim 6, said bubble director further comprising a base surrounding said bubble port, said base being in said first region and shaped to direct said air bubble towards said guide.

12. The fluid reservoir as recited in claim 11, wherein at least a portion of said base is further shaped to allow said inflatable bag to inflate to a specified volume.

13. The fluid reservoir as recited in claim 11, wherein said base includes at least one capillary feature formed therein that is configured to direct said fluid to said bubble port.

14. The fluid reservoir as recited in claim 13, wherein said base includes a stage that elevates said base above a floor of said housing, and wherein said capillary feature is further at least partially formed within said stage and said capillary feature contacts said floor.

15. The fluid reservoir as recited in claim 11, wherein said base includes at least one notch configured to direct said fluid into said bubble port.

16. The fluid reservoir as recited in claim 1, said bubble director comprising two parallel, spaced guides on said inner wall surface extending from said first region to said second region, said two parallel, spaced guides forming said path of said bubble director therebetween.

17. The fluid reservoir as recited in claim 1, said resilient member comprising at least one cantilever beam spring that provides a substantially consistent amount of force.

18. The fluid reservoir as recited in claim 1, wherein said housing is operatively arranged within a printing device to supply said fluid to a fluid ejection mechanism.

* * * * *